US005521566A

United States Patent [19]

Krubsack et al.

[11] Patent Number: 5,521,566

[45] Date of Patent: May 28, 1996

[54] HIGH AMPERAGE SOLENOID STRUCTURE

[75] Inventors: Larry J. Krubsack, Colgate; Richard M. Heiden, Hartford; Allen L. Handy, North Prairie, all of Wis.

[73] Assignee: Clum Manufacturing Company, Inc., Hartford, Wis.

[21] Appl. No.: 296,005

[22] Filed: Aug. 25, 1994

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS

| | | | |
|---|---|---|---|
| 3,194,918 | 7/1965 | Muscante et al. . | |
| 3,688,230 | 8/1972 | Tichy . | |
| 4,293,835 | 10/1981 | Davis et al. | 335/126 |
| 4,521,758 | 6/1985 | Krubsack | 335/131 |
| 5,021,760 | 6/1991 | Krubsack et al. | 335/196 |

*Primary Examiner*—Lincoln Donovan

*Attorney, Agent, or Firm*—Andrus, Sceales, Starke & Sawall

[57] ABSTRACT

A solenoid unit for use in high amperage environments includes a hollow cup-shaped housing having a closed end and an open end. A contact section is located adjacent to the closed end, and a coil section is located adjacent to the open end. The closed end includes an end wall. First and second power contact terminals each include a threaded member extending exteriorly for receiving a lead clamping nut. Each terminal includes an enlarged mounting head embedded within the end wall, with an inner contact extending from the end wall. Each head includes a circumferential knurled surface to oppose rotational and axial forces and thereby permits high clamping torque forces on the nut. A bridging contact is aligned with the inner contact ends of the terminals and moves axially thereof. The housing includes inwardly extending opposed locating members which define the contact chamber and guide the bridging contact within a free space to cool the contact assembly. The coil assembly is coupled to position the contact between engagement with the contact ends and spaced therefrom.

34 Claims, 3 Drawing Sheets

HIGH AMPERAGE SOLENOID STRUCTURE

BACKGROUND OF THE INVENTION

The present invention relates a high amperage solenoid structure and particularly to such a switch structure which operates with current rating in hundreds of amperes for operating of various recreational vehicles, heavy equipment including material handling equipment, electric vehicles, emergency equipment, golf carts and earth moving equipment and the like.

Solenoid switch devices are widely used for interconnecting of power current sources to a load in response to a relatively low level control current. The assignee of this invention has designed commercially successful solenoid switch devices for use in various applications, generally for lower current rating such as automobile starters, lawn tractors and other like applications. Highly successful structures are shown in U.S. Pat. No. 4,521,758 which issued Jun. 4, 1985 and U.S. Pat. No. 5,021,760 which issued Jun. 4, 1991. Both the '758 and '760 patents are assigned to the common assignee of this application. The patents disclose relatively compact solenoid switch units particularly operable in high vibrational environments with improved contact support and enclosure. The prior art structures made under such patents have generally been directed to current loads on the order of 100 amperes, with voltage of 6 and 12 volts. Although the structures as disclosed in the above patents and in other patents may also be suitable for high amperage applications, the present inventors have found certain limitations on prior art systems disclosed and heretofore when applied at higher amperage ratings. Thus, currently some users require a rating of 300 peak amps. High currents require special consideration as to insulation establishing proper contact closure and opening and establishing proper terminal connectors. In addition, short circuiting of the high current output terminals is more critical than conventional low rated capacity applications. However, the mounting and size requirements are generally such as to require a compact device which will operate in various environments encountered in industrial strength solenoid applications, including a very wide range of temperatures, from well below zero to temperatures approaching boiling temperatures.

SUMMARY OF THE PRESENT INVENTION

The present invention is particularly directed to an industrial strength solenoid structure having improved terminal structure and insulation characteristics for application in various industrial applications or installations with high current rating, and in a compact construction adapted to be mounted in a manner similar to that of present solenoid structures. More particularly, in accordance with the present invention, the solenoid structure includes an outer molded housing having high amperage terminal studs with a special mounting head molded within the housing wall between an external threaded stud and an inner contact portion within the molded housing. The embeddment of the head is such as to establish and produce a high torque anti-turn characteristic whereby a high torque can be applied to a clamping nut of the terminal. The housing includes an integrated separation wall projecting upwardly between the contact terminal studs, with the wall projecting above the level thereof to avoid accidental shorting of the output current. In addition, the internal wall structure of the housing is specially shaped to maintain the high current contact assembly appropriately in location to the contact studs for firm engagement with the inner ends of the contact studs as well as to establish maximum internal insulation. In addition, the contact assembly includes a movable contact assembly including a blade contact mounted on a moving rod or plunger coupled to a moving arm of a coil assembly generally as disclosed in the above-cited prior patents. The armature structure includes a fixed magnetic plug secured to the coil magnetic frame, with the contact plunger assembly slidably mounted in a central opening. A movable armature is located within a coil unit and moves in response to the actuating current to move the contact assembly to a closed position.

The contact assembly also preferably includes a carrier extension such as generally disclosed in the prior patents. In the present invention, the carrier extension is a multiple part member having an extension member or plunger which passes through a fixed pole piece in the coil assembly. The plunger is a rod-like member with an upper head or flange portion defining an enlargement integral with the rod. The upper surface of the flange is recessed to receive a spring washer which acts between the inner top wall of the housing and the plunger. An insulating bushing abuts the underside of the flange with a tubular portion which extends downwardly through a contact plate. A retaining washer is secured to the rod in spaced relation to the location of the contact plate and the bushing, and supports a plunger spring which expands upwardly into engagement with an insulating washer located between the underside of the contact plate and the spring. The plunger extension is journaled in the magnetic plug and extends therethrough into engagement with the end of the armature.

The coil assembly is generally constructed with a bobbin frame, a central tube and end walls, with the coil wound on the tube between the end walls. The bottom end wall of the bobbin is provided with a lead extension. It has a small lead opening aligned with the outer edge of the coil to receive the coil lead. The lead extends outwardly through a groove in the underside of the lead extension. Each coil stud is a small diameter bolt unit having a specially formed head with serrated edge surfaces, or alternatively may take the form of a spade-type terminal. The heads are embedded within the molded housing extension to firmly secure the studs in place and insure the reliable mounting of the studs in combination with reliable support of the leads which are soldered or otherwise secured thereto. The studs are case hardened and threaded to receive clamping nuts, preferably with a self-locking flange.

The upper wall of the bobbin has spacing members projecting upwardly therefrom.

The coil and bobbin assembly are located within an inverted magnetic can, the upper wall of which abuts a ridge within the molded housing. The bottom of the housing is closed by a cover structure with a sealing gasket between the base of the housing and a bottom cover. In some cases, a coil spring continuously urges the coil assembly and the can upwardly into abutting engagement within the housing, generally as disclosed in the inventor's prior noted patents.

The insulating housing has a specially configured contact chamber with a central opening for receiving of a head spring. The outer end of the cup-shaped housing is enlarged to accommodate the coil assembly including the magnetic can. The contact assembly is located above the can within the enlarged portion of the housing. The housing wall is formed with special guide members projecting inwardly along the depth of the contact chamber. The guide members are generally Y-shaped elements, the inner ends of which are located in slightly spaced relation to the side edges of the contact plate. The Y-shaped guides extend inwardly from the outer end wall and between the contacts.

The exterior of the housing may be formed with a small handle portion generally in a form of a channel-shaped structure secured to one side of the housing.

The assembly of the plunger and the fixed magnetic plug member and the contact support structure is particularly adapted to the high amperage rated solenoids. The contact assembly establishes a firm, reliable interengagement of the contact plate to the stud power contacts to complete the circuit therebetween. The plunger assembly provides and maintains a positive and firm interengagement of the movable and fixed contacts within the housing. The round construction of the housing adapts the unit to either form of a conventional bracket, including an encircling strap with extended arms, in which the outer arms may be a flat or curved members depending upon the particular application of the solenoid. Alternatively, the housing may be mounted vertically via a bracket mounted to the lower end of the housing.

The present invention with the special embedded contacts and the enlarged insulating wall structure as well as the modified coil connection and plunger assembly provides a particularly suitable and practical implementation of the prior design for high amperage applications.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE ILLUSTRATED EMBODI

MENT

Figure 1:
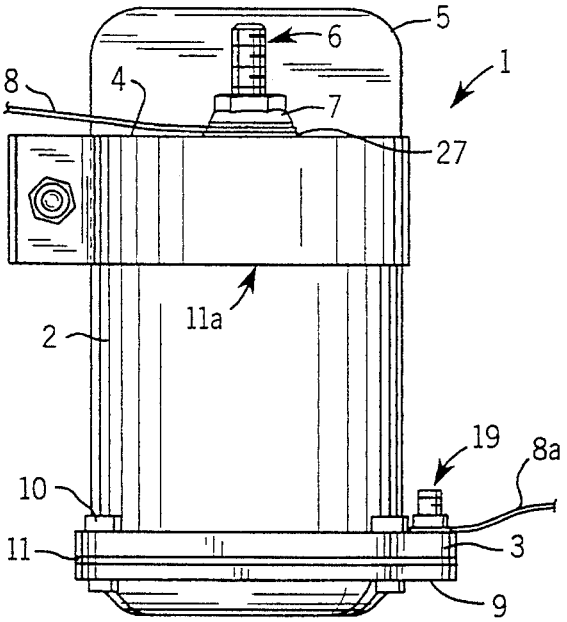
FIG. 1 is a side elevational view of a solenoid constructed in accordance with the teaching of the present invention.
Figure 3:
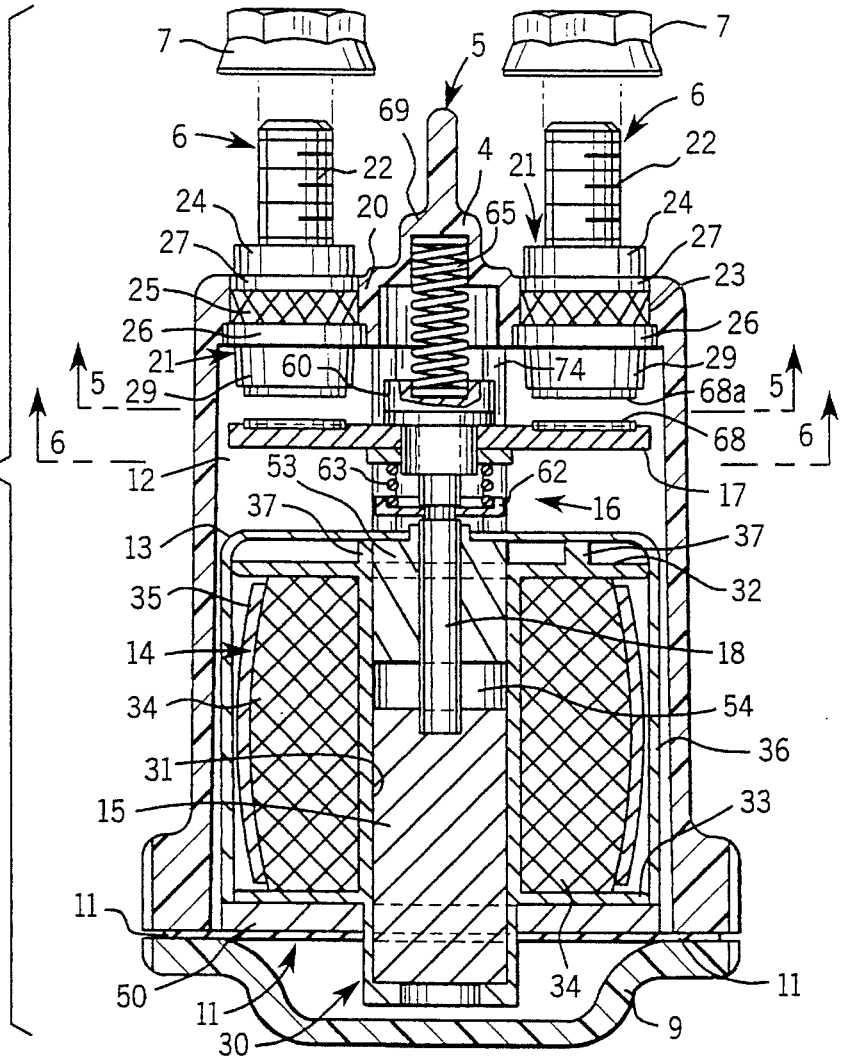
FIG. 3 is a vertical section taken generally on line 3—3 of FIG. 2.
Figure 7:
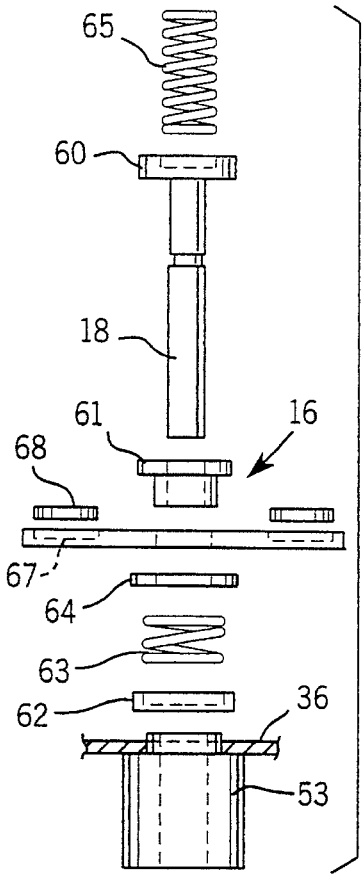
FIG. 7 is an exploded view of the plunger extension sub-assembly as shown in FIG. 4.
Figure 2:
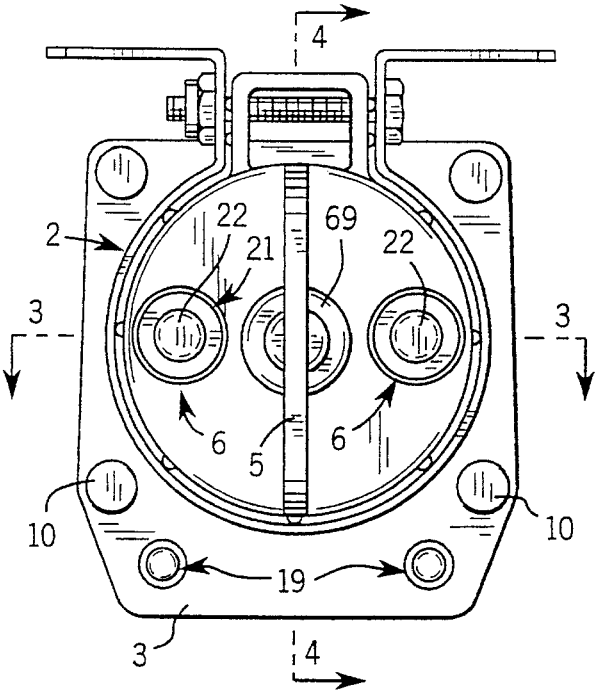
FIG. 2 is a top view of the solenoid shown in FIG. 1.
Figure 5:
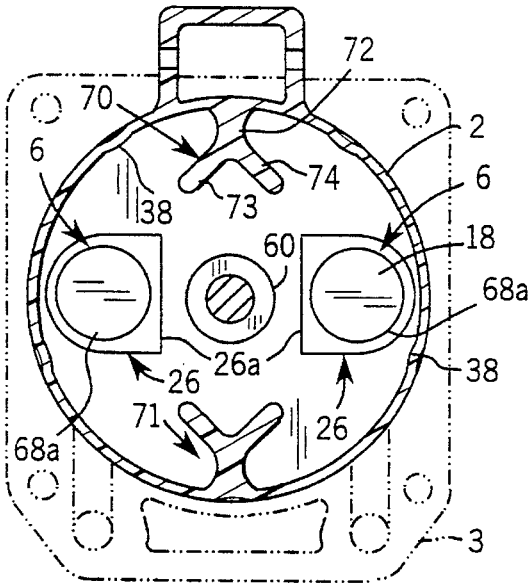
FIG. 5 is a cross-sectional section taken generally on line 5—5 of FIG. 3.

Referring to the drawings and particularly to FIGS. 1–3, a solenoid 1 is illustrated constructed in accordance with the teaching of the present invention. The solenoid 1 includes an outer housing 2 shown as a generally cylindrical housing and having a base or flange 3 secured to an open end. The flange 3 projects outwardly as a generally rectangular extension. The upper end of the housing 2 is formed with a generally flat top wall 4 with a centrally upstanding outwardly extended separation wall 5. A pair of fixed high amperage power terminals 6 are secured on opposite side wall 5 to the upper or top wall 4. Each power terminals 6 is a threaded stud adapted to receive high torque clamping nuts and/or lock washers 7 and establish a firm interengagement of a power lead 8 to the terminal. Solenoid activating terminal 6 are secured to the bottom wall flange 3. The terminals 6 are threaded stud members for receiving incoming low voltage, operating leads 8*a*.

The cup-shaped solenoid housing 12 is formed with an open bottom at the flange 3. A metal or plastic bottom cover 9 substantially shaped to that of the housing bottom including the terminal flange 3 is secured to the housing 2 by clamping rivets 10. A suitable gasket 11 is interposed between the bottom cover 9 and the housing bottom to provide a moisture retardant construction.

A conventional bracket assembly 11*a* is secured about housing 2 to mount solenoid 1 in a horizontal orientation in a conventional manner. Alternatively, a mounting plate may be secured to the lower end of solenoid 1 for vertical mounting, as shown in U.S. Pat. No. 5,021,760.

Figure 4:
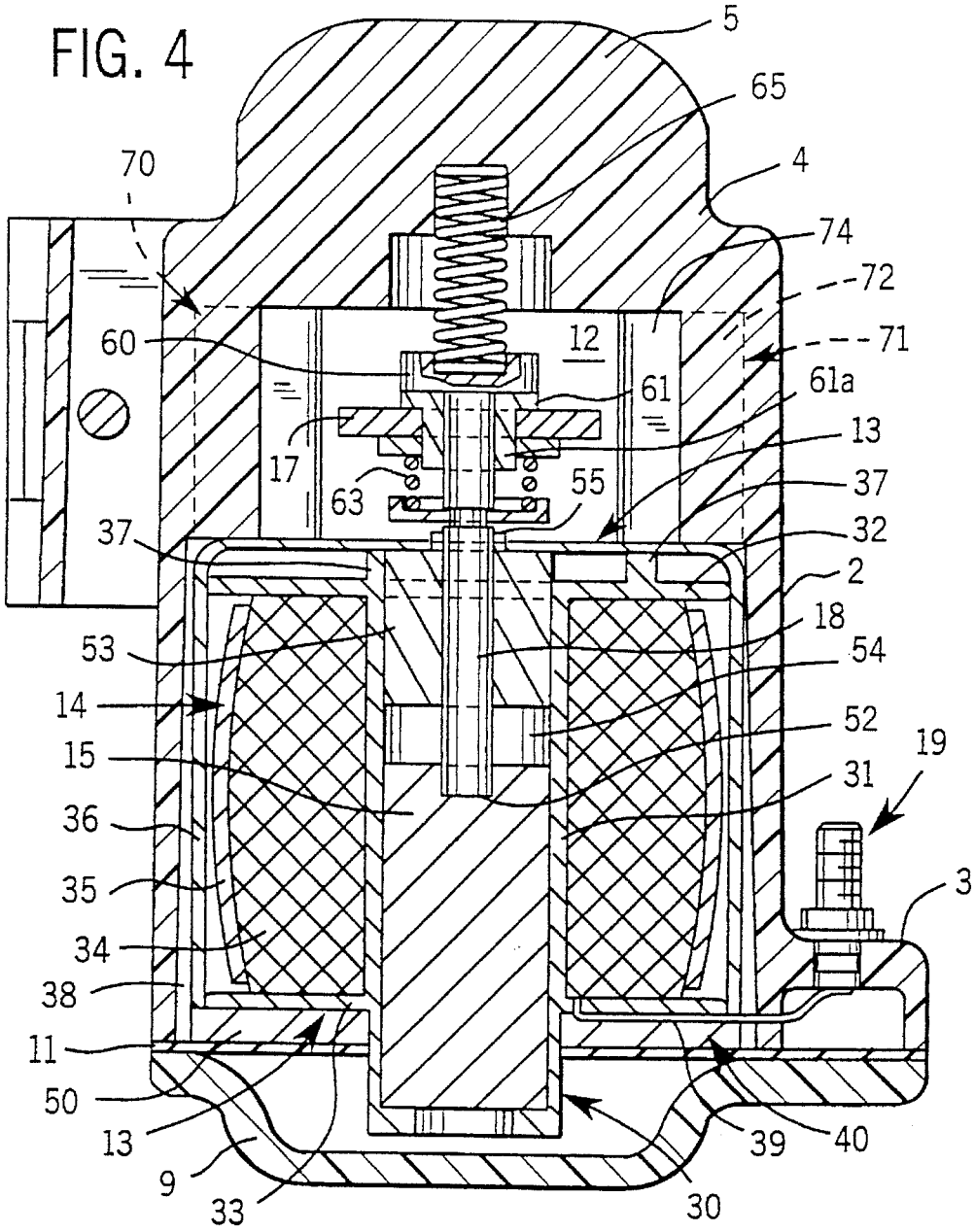
FIG. 4 is a vertical section taken generally on line 4—4 of FIG. 2.
Figure 4A:
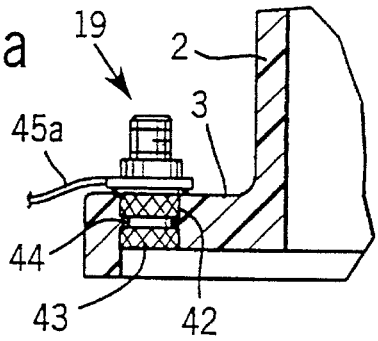

Referring to FIGS. 3 and 4, the solenoid housing 2 is generally formed with an step internal construction with a contact chamber 12 formed in the closed end of the housing and an armature and coil assembly chamber 13 in the outer or open end of the housing. An annular coil and armature assembly 14 is housed within the armature and coil armature chamber 13 and includes an armature 15 moving axially of the housing. A contact and extension assembly 16 is located in chamber 12 and is coupled to the armature 15, with a movable contact member 17 located within the contact chamber. The extension assembly 16 includes a coupling rod 18 which is biased to engage the armature 15 and resiliently urge the armature toward the closure or bottom cover 9. The contact member 17 is a plate-like member which bridges the pair of fixed power terminal contacts 6. The exposed inner ends of terminals 6 are solid conductive ends spaced inwardly to the top wall for selective engagement by axially moving of the contact member 17 in response to energizing of the coil assembly 14. The present invention is particularly directed to the construction of the contact extension assembly 16, the provision of an improved housing 2 and support of the power terminals 6 while maintaining a compact reliable solenoid unit for use in high amperage applications.

More particularly, the housing 2 is a plastic molded housing with the power terminals and the input or operating terminals 19 for energizing the coil armature assembly in place as an integrated part of the housing.

Referring particularly to FIGS. 3 and 4, the upper end of the housing 2 is formed with an integral top wall 20 with the power terminals 6 formed as headed bolt members having a head 21 and a threaded stud 22 extending outwardly of the top wall. The head 21 of the bolt member is formed as a solid body having a diameter significantly greater than the exposed threaded stud 22. The head 21 extends through the top wall 20 with an inner contact member, an intermediate attachment and locking attachments portion 23 and an outwardly projecting portion 24 defining a flat outer surface from which the threaded stud 22 projects. The attachment portion 23 is located completely within the top wall 20, and includes a central portion especially configured to intermesh with the molded plastic of the top wall 20 to lock the terminal in place against both turning forces and axial forces. The intermediate portion 25 includes a knurling, shown extending about the complete circumference of the head. The knurled diamond pattern 25 within the high strength mold housing wall 20 establishes maximum holding forces against turn forces created when tightened of the clamp nut 7 to the stud. The knurl pattern also establishes a large axial holding force and maintains the terminal 6 in place against damaging forces; for example, dropping of a tool or other member on the outer end and of the terminal. The opposite ends of the knurled head include an inner flange 26 of a diameter slightly greater than that of the knurled portion and an outer ring 27 of a slightly smaller diameter. The inner flange 26 has a flat edge wall 26*a* embedded within the top. The flat edge wall further supports the terminal against torque forces on the terminal. The outer ring 27 projects outwardly through the plastic and defines a flat surface located outwardly of the surface of the top wall 20. The threaded stud 22 projects outwardly therefrom and is adapted to receive the clamping nut 7.

The inner contact portion 29 of the terminal 6 extends inwardly with a smooth finished face 18 adapted to engage the mating contact member 17.

The threaded studs 22 are also spaced outwardly from the isolating wall 5 to permit attachment of the clamping nuts 7. The mounting of the terminals 6 to the molded plastic housing with the enlarged knurled heads 23 embedded in the top wall, and with the other special interlocking surfaces permits a high torque tightening of the clamp nuts as required to insure a reliable electrical interconnection between the terminal contact and the incoming lead.

The insulating wall 5 which extends upwardly above the ends of the studs 6 a slight distance insures that the operator will not accidently bridge the two studs and create a short circuit across the high amperage power connections.

In a practical application, the high amperage terminals 6 are hard drawn and plated for durability and corrosion prevention.

The coil and extension assembly 13 is similar to that disclosed in U.S. Pat. No. 4,521,758. The coil assembly 14 includes a bobbin 30 with a central tube 31 and with axially spaced and outwardly extended end walls 32 and 33 defining a coil chamber encircling the tube 31. A winding 34, diagrammatically illustrated, is wound about the tube 31 within the outer confines of the end walls 32 and 33. An outer encircling insulating wrap 35 encircles the periphery of winding. A magnetic frame in the form of an inverted U-shaped can 36 is telescoped over the winding assembly and bobbin. The upper wall 32 of the bobbin has a plurality, shown as three, of equicircumferentially spaced locating projections or member 37 projecting co-axially outwardly therefrom. The projections 37 locate the winding 34 within the can 36 with an air circulation space above the coil assembly 14. The inner wall of the housing 2 has a plurality of longitudinally extended ribs 38 which engage the can wall and define an air circulation space about the can.

The connection to the winding 34 is through lead connectors 39 secured to the bottom wall or flange 33 of the bobbin and projecting outwardly within flange 3. A small opening in the bottom flange 33 connects to a recess 40 in the underside of the lead member. The connecting lead of the coil 34 is extended through the opening and embedded within the recess and extends outwardly into an opening in the flange 3.

The coil terminal 19 is formed with an enlarged head 41 embedded in the wall of the flange 3. The head 41 includes a pair of axially spaced coarse knurls 42 and 43 over spaced circumferences of the head. The knurls are formed by a plurality of immediately adjacent curved portions joined by axial edges. An encircling groove 44 is located between the spaced knurled portion. The innermost end of the coil terminal 19 is provided with a flat surface to which the output coil leads are soldered or otherwise appropriately secured. The exterior side of the outer knurled portion 42 includes a round extension formed with an outer flat surface from which the threaded stud projects to receive the incoming lead 45*a*. A locking nut 46 secures the lead 46 to the terminal 19. The terminals 19 are preferably case hardened and plated.

The canned winding and armature assembly 13 is clamped in place by a bottom cover 9 located abutting gasket 11, a lower washer 50, and the lower bobbin flange 33. Bobbin flange 33 includes split fingers as disclosed in U.S. Pat. No. 5,021,760, which engage housing 2 to prevent turning of the coil unit. Gasket 11 and bottom cover 9 seal the lower end of housing 2 below lower washer 50. The gasket 11 is formed of a non-conductive material which is relatively stiff but flexible. The gasket 11 spans the outward dished cover 9 and acts as a spring to hold the assembly within the coil chamber 13.

The armature 15 is a cylindrical magnetic slug with flat ends. The armature 15 is slidably mounted within the bobbin tube 31 with a close sliding fit. The one end of the armature has a recess 52 for coupling to the contact extension assembly and particularly rod 18. The length of the armature 15 is less than the length of the tube 31 and is shown of a length slightly greater than one-half the total length of the tube. A magnetic plug 53 is secured to the can 36 within the upper end of the tube 31. The plug 53 is a magnetic member, preferably the same material of the armature. The length of the plug 53 is such that with the armature 15 located in engagement with the outer end of the tube 31, there is a distinct gap 54 between the opposed ends of armature 15 and magnetic plug 53. The can 36 has a small central opening aligned with the center of tube 31. The plug 53 has a short tubular extension 55 extending upwardly through the can opening and firmly press fitted and supported therein. Thus, the plug 53 is held within the outer end of the bobbin tube 31 with the adjacent surface of the plug abutting the can 36 and forming a part of the magnetic path. Energization of the winding 34 results in creation of a magnetic flux through the armature, the plug and the can, creating a magnetic force on the armature 15 causing it to move upwardly within the coil, toward and into engagement with the end of plug 53, and simultaneously moving the rod 18 of contact and extension assembly 16 outwardly of the bobbin within chamber 12.

The contact and extension assembly 16 is generally similar to that shown in the applicant's prior patents but again is specially modified to accommodate for high current application.

The extension assembly includes the elongated plunger 18 with a diameter which slides smoothly through the plug member 53 the inner end located within the recess 52 in the end of the armature 15. The extension rod 18 also passes through the contact plate 17 and includes an outer or end head 60 having an enlarged diameter so as to prevent movement of the extension plunger throughout the assembly. An insulating bushing 61 is mounted on the plunger rod 18 abutting the underside of the head 60 and includes a hub 61*a* extending downwardly through a corresponding opening in the contact plate 17. A retaining washer 62 is secured within an annular groove in the rod 18 in outwardly spaced relation to the head and bushing. The retaining washer has an upstanding outer flange defining a spring retaining recess. A plunger spring 63 is located within the retaining washer 62, encircling the rod 18, and expands outwardly toward the contact member 17. A second flat fiber insulating washer 64 is interposed between the spring and the contact member. The spring 63 acts between the fiber washer 62 and the contact member 17 to hold the contact member into firm but resilient supported engagement with the plunger head 60. In accordance with the teaching of the prior applications, a head spring 65 is located between the head 60 and the top wall 20 of the housing 2. The head 60 has a slight recess to accommodate the head spring which extends outwardly therefrom into a corresponding recessed portion in the inner surface of the top housing wall 20. The head spring 65 biases the plunger rod 18 inwardly from the top wall 20 and through the coil assembly 14 and particularly the magnetic plug into engagement with the armature 15. This simultaneously moves the contact member outwardly into spaced relation to the inner contact faces 18 of the power terminals 6 and breaks the high amperage current circuit.

The contact member 17 is a generally rectangular plate having rounded ends. The plate extends diametrically across the housing with the outer ends spaced slightly from the sidewall in chamber 12 of the housing 2. The contact member may be a conductive copper member or provided with silver contacts, as shown. With silver contacts, the contact face of the contact plate 17 is recessed as at 67, with a silver chip 68 secured within the recess, for example, as by brazing.

The power terminals 6 are also formed with a silver contact chip 68*a* brazed or otherwise secured to the inner portion of terminal 6 to form contact face 18. A satisfactory silver composite material for contact chip 68*a* consists of a combination of 60% molybdenum and 40% silver. Alternatively, a material consisting of 90% silver and 10% cadmium oxide is believed satisfactory. The silver chips provide a low resistance contact surfaces for carrying the higher amperage current without damaging of the contacts and providing for a long life and operation thereof.

The plunger assembly with the insulated components significantly contributes to the minimal heating of the system and a long operating life with a current passing directly through the contact plate and the interconnected terminals.

The top wall 20 of the housing is shown having an enlarged recess adjacent to the spring retaining recess. The recess also defines a large encirclement 69 of the housing 2 about the separating wall 5 between the high amperage studs of terminal 6. Thus, it particularly provides a high insulation between the location of the power terminals as well as the connecting nuts.

Figure 6:
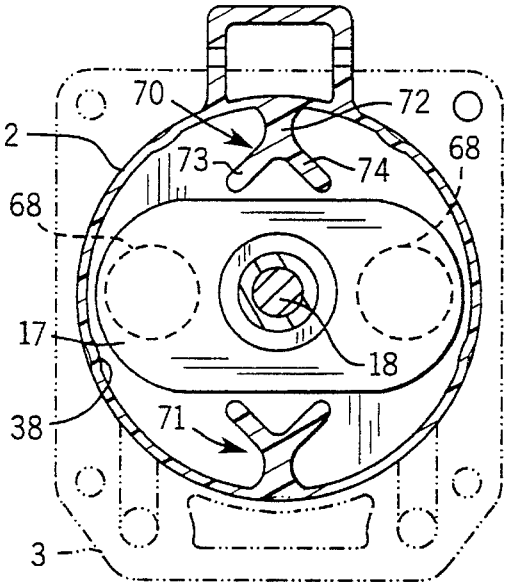
FIG. 6 is a cross-sectional view taken generally on line 6—6 of FIG. 3.

The ends of contact member 17, as previously described, are located spaced slightly from the sidewall of the housing. To further guide the member 17 and particularly to prevent turning or lateral shifting thereof, special guide members 70 and 71 are secured in any suitable manner to project inwardly from the sidewalls adjacent the sides of the contact member, as most clearly shown in FIG. 6. The guide members 70 and 71 are shown of an identical construction, and member 70 is described in detail in a preferred embodiment.

Member 70 is a Y-shaped member having the stem 72 integrally molded to the housing sidewall and projecting generally radially inwardly. The angled arms 73 and 74 of the member 70 project inwardly from the stem 72 and terminate in slightly spaced relation to the edges of the contact plate 17 and prevent any significant lateral movement relative to the terminals 6.

In addition, in the illustrated embodiment of the invention, the Y-shaped members 70 and 71 project axially or longitudinally of the chamber 12 and terminate at the junction between chambers 12 and 13. The inner most ends of the member 70 and 71 define the stop members which are engaged by the can 36 of the assembly 14 to properly locate and orient the armature and the contact assemblies for high performance solenoid operation.

The Y-shaped members are selected to produce proper location and movement of the parts while maintaining a maximum free space about the contacts and over the coil assembly. This permits an optimum self cooling characteristic of the solenoid, which is substantially significant for high amperage rated solenoids. Other spaced members may be used to locate the parts, but should be located and oriented to also promote cooling of the solenoid components.

Various modes of carrying out the invention are contemplated as being within the scope of the following claims particularly pointing out and distinctly claiming the subject matter which is regarded as the invention.

We claim:

1. A solenoid unit for use in environments requiring ratings of up to generally 300 amperes, comprising a hollow generally cup-shaped housing having a closed end wall and an open end and including a contact section adjacent said closed end wall and a coil section adjacent said open end, said end wall having a first power contact terminal and a second terminal laterally spaced on said end wall, the improvement comprising wherein each of said terminals includes a threaded member external to said end wall and adapted to receive a clamping nut for clamping a power lead to the power terminal, said terminal having an enlarged mounting head integrally formed to said threaded member, said mounting head embedded within said end wall and including an inner contact end exposed within said contact section, said head having a circumferential knurled surface embedded within said end wall and forming an interconnection therebetween including a first portion opposing torque forces applied to said threaded member and a second portion opposing axial forces applied to said threaded member to thereby permit the application of a high clamping torque to the clamping nut applied to said terminal and resisting rotational and axial forces applied to said terminal, a contact assembly mounted within said contact section and including a bridging contact member located in alignment with said inner contact ends of said terminals and mounted for axial movement into and away from said contact ends within said contact section, and a coil assembly in said coil section and coupled to said contact assembly to position said bridging contact member in a first position engaging said contact ends and in a second position spaced from said contact ends.

2. The high amperage solenoid unit of claim 1 wherein said knurled surface comprises a knurled circumference surface of a diamond configuration embedded within said plastic end wall to provide both rotational resistance and said axial resistance to corresponding loads applied to said terminals.

3. The solenoid unit of claim 2 wherein each of said terminals include a threaded stud terminating in a common plane generally parallel to said end wall, a separation wall integrally formed with said end wall of said housing and extending as a substantially straight wall across said housing and between said terminals to establish and maintain electrical separation therebetween, said separation wall being laterally spaced from said studs for receiving a nut and projecting significantly upwardly above said common plane to prevent accidental shorting of said power terminals to each other.

4. The solenoid unit of claim 1 wherein each terminal having an integral inner contact end includes an inner surface exposed within said contact section and including an exterior flat portion with said threaded portion extending outwardly therefrom, said inner contact end including a flat edge wall embedded within the top wall and further supporting said terminal against torque forces on said terminal.

5. The high amperage solenoid of claim 1 wherein said contact member has a generally rectangular configuration with opposite end edges and opposite side edges extended between said end edges, the length of said contact member between said end edges being slightly less than the width of said contact section and said side edges being spaced from each other by a distance substantially less than the distance between said side walls of said contact section, said side walls aligned with said side edges each having at least one locating member projecting inwardly toward said side edge and defining a guiding passage for movement of said contact member and preventing significant rotation of said contact member, said locating members establishing substantial free space within said contact section to maintain an effective cooling of the contact assembly.

6. The solenoid unit of claim 5 wherein said coil section extends from said contact section and has one end defined by the inner ends of said locating members, said coil assembly including a cup-shaped can formed of a magnetic material and having a peripheral configuration substantially corresponding to the inner peripheral configuration of said housing within said coil section to establish a press fit between said can and said side wall, a coil unit mounted within said can, a cover member secured to the open end of said housing, a gasket interposed between the bottom end of said housing and said cover and spanning the opening of said housing, said cover having an offset portion spaced from said gasket, said gasket being constructed and arranged to seal the connection of the cover to said housing and further to resiliently support said magnetic can and coil unit within said housing with said can abutting said locating members.

7. The solenoid unit of claim 6 wherein said housing includes a plurality of spacing ribs within the coil section engaging said can and defining an air space about the can.

8. The solenoid unit of claim 6 wherein said can has a base adjacent said contact section and including spacing elements located between the coil and the base to define an air space therebetween.

9. The solenoid unit of claim 6 wherein said coil unit includes a bobbin having a central tubular member and inner and outer end walls, said inner end wall having spacing elements engaging said can and spacing said inner end wall therefrom.

10. A high amperage rated solenoid unit for providing power in a range of 150 amperes or more, comprising a rigid plastic housing molded in a generally open-ended cup-shaped having a generally cylindrical side wall and a closing end wall and an open access end, said open access end having a mounting flange, said end wall having first and second power terminals embedded in said end wall, said housing having a plurality of circumferentially spaced locating members secured to said side wall in opposed opposite relation and projecting inwardly toward each other and the center of said housing and terminating in spaced guide ends, said locating members having longitudinal inner ends defining a contact chamber located between the closing end wall and an intermediate location of said side wall, a coil chamber in the open end of said housing extending between the ends of said locating members and the outer end of said open access end, a contact assembly located within said contact chamber and having a contact member movable between said guide ends of said locating members, and a coil assembly located in said coil chamber and electromagnetically coupled to said contact assembly to position said contact member.

11. The solenoid unit of claim 10 wherein said coil assembly includes a magnetic cup-shaped can formed of a magnetic material and having an inner can base abutting said inner ends of said locating members, a cylindrical coil unit located within said cup-shaped can and including an annular bobbin with a cylindrical coil wound on said bobbin, said bobbin having a central axial opening, a magnetic plug secured to the inner end of said central axial opening adjacent said contact section, an armature axially sliding in said central opening outwardly of said plug and of a length defining a gap between said plug and said armature with the armature located adjacent said open end, said cylindrical wound bobbin disposed in said can with the inner end of the bobbin adjacent said inner can base, and said armature is coupled to said contact assembly and said contact member.

12. The solenoid unit of claim 11 wherein said bobbin includes a plurality of spacing members interposed between the base of said can and said bobbin to define a space therebetween.

13. The solenoid unit of claim 11 including a closing plate secured to the open end of said can and a projecting member provided on said bobbin and engaged with said housing to prevent rotation of said bobbin, a bottom cover secured to the open end of said housing and including a central portion aligned with the bobbin and said armature and spaced outwardly thereof, a flat resilient flexible gasket interposed between said flange and said cover and spanning the opening of the housing and engaging said adjacent bobbin, said gasket being constructed and arranged as a resilient support for said can and coil unit and holding said can and coil unit in abutting relation to said locating members.

14. The solenoid unit of claim 11 wherein said contact member of said contact assembly is a contact plate located within said contact section and spanning the housing between said guide ends of said locating members, said locating members providing a guided axial movement within said housing between an open position and a contact closing position engaging said power terminals, said contact assembly including a transfer member extended through said plug and into said releasable coupling to said armature for selectively positioning of said contact member between said open and closed position in accordance with the energization of said coil unit.

15. The apparatus of claim 13 wherein each of said power terminals includes a single integrated unit including an outer exposed threaded stud and an enlarged head embedded within said end wall, said enlarged head having an intermediate locking portion and an inner portion projecting inwardly of said surface of said end wall and forming a power contact within said contact section, said enlarged head having an outer portion projecting outwardly from said locking portion and having an outer flat wall located slightly outwardly of the outer surface of said end wall and having said threaded stud projecting outwardly from said outer flat wall, said locking portion having a highly knurled portion providing for axial support of said terminal within said end wall and circumferential support of said terminal within said end wall whereby said stud is firmly supported against deflection as a result of locking torque applied to said stud and against axial forces applied to said stud.

16. The apparatus of claim 11 wherein said armature moves to close said contacts in said first position and simultaneously engages the adjacent end of said fixed magnetic plug.

17. The apparatus of claim 16 wherein said contact member is a metal plate having a central opening, an insulating bushing is mounted within said central opening and includes a flange abutting the metal plate to the inner side within said contact section, a brass rod extends through said bushing and includes a head abutting said flange, a first spring located between the housing and said rod flange and urging the rod and contact plate outwardly of said terminals, a second spring engaging the retaining washer on said rod and having an outer insulated end engaging said contact plate to resiliently hold said contact plate into engagement with said bushing head, said rod extending downwardly through said plug and extending into said armature, said armature having a recess corresponding generally to the configuration of said rod for receiving the end of said rod with a loose releasable coupling whereby inward movement of said armature pushes said rod upwardly to transfer said contact plate into the closing position.

18. The apparatus of claim 13 wherein said gasket is formed of a flat resilient flexible material.

19. The apparatus of claim 15 wherein said locking portion includes a knurled portion extending circumferentially about said locking portion.

20. The apparatus of claim 19 wherein said knurled portion extends for 360 degrees of said locking portion.

21. The apparatus of claim 10 wherein said mounting flange includes an outward extension therefrom, a first and second coil contact located in spaced relation to each other within said flange, each of said coil contacts including a single integrated solid conductor consisting of a stud for receiving a lead and an enlarged head embedded within said flange, said head including a knurled locking portion for locking of the contact within said flange.

22. The apparatus of claim 21, wherein said knurled portion includes a pair of spaced knurled portions connected by a groove, said first and second knurled portion each consisting of circumferentially spaced and longitudinally extended grooves connected by a sharp edge whereby said knurled portions resist torque on said terminal, said groove between said first and second power contact knurled portions providing axial support for the coil contacts.

23. A high amperage rated solenoid unit for use in environments requiring ratings of up to generally 300 amperes, comprising a hollow generally cup-shaped housing having a closed end wall and an open end and including a contact section adjacent said closed end wall and a coil section adjacent said open end, said end wall having a first power contact terminal and a second terminal laterally spaced on said end wall, the improvement comprising wherein each of said terminals includes a threaded member external to said end wall and adapted to receive a clamping nut for clamping a known lead to the power terminal, said terminal having an enlarged mounting head integrally formed to said threaded portion and embedded within said end contact section, said head having a circumferential knurled surface embedded within said molded top wall and forming an interconnection therebetween opposing torque force applied to said threaded member and axial forces applied to said threaded member to thereby permit the application of a high clamping torque to the clamping nut applied to said terminal and resisting axial forces applied to said terminal unit, a contact section including a contact assembly having a bridging contact member located in alignment with said inner contact ends of said terminals and mounted for axial movement into and away from said contact ends within said contact section, said contact member having a generally rectangular configuration with opposite end edges and opposite side edges extended between said end edges, the length of said contact member being slightly less than the width of said contact section and said side edges being spaced from each other by a distance substantially less than the distance between said side walls of said contact section, said side walls aligned with said side edges each having at least one locating member projecting inwardly toward said side edge and defining a guiding passage for movement of said contact member and preventing significant rotation of said contact member, said locating members establishing substantial free space within said contact section to maintain an effective cooling of the contact assembly, said coil section being located immediately adjacent said contact section and defined by the inner ends of said locating members, a coil assembly including a cup-shaped can formed of a magnetic material and having a peripheral configuration substantially corresponding to the inner peripheral configuration of said housing within said coil section to establish an interference fit between the sides of said can and said side wall, a coil assembly mounted within said can, a magnetic plate closing said can and abutting said can, a cover member secured to the open end of said housing, a gasket interposed between the bottom end of said housing and said cover and spanning the opening of said housing, said cover having an offset portion spaced from said gasket, said gasket being constructed and arranged to seal the connection of the cover to said housing and further to resiliently support said can and coil unit within said housing with said can abutting said locating members.

24. The high amperage solenoid unit of claim 23 wherein said power terminals in said locking portion having a knurled circumferential surface embedded within said plastic top wall.

25. The solenoid unit of claim 23 wherein each said terminal includes a threaded stud terminating in a common plane generally parallel to said end wall, a separation wall integrally formed with said top wall of said housing and extending as a substantially straight wall across said housing and between said terminals to establish and maintain electrical separation therebetween, said wall projecting significantly upwardly above said common plane to prevent accidental shorting of said power terminals.

26. The solenoid unit of claim 24 wherein an inner contact end includes an inner surface exposed within said contact section and including an outer contact portion with said threaded portion extending outwardly therefrom, said inner contact end including a flat edge wall embedded within the top wall to further support said terminal against torque on said terminal.

27. A high amperage rated solenoid unit for providing power in a range of 150 amperes or more, comprising a rigid generic definiteness of housing plastic housing molded in a generally open-ended cup-shaped having a generally cylindrical side wall, a closing end wall and an open access end, said open access end having a mounting flange, said end wall having first and second power terminals embedded in said end wall, said housing having a plurality of circumferentially spaced locating members secured to said side wall in opposed opposite relation and projecting inwardly toward the center of said housing, said locating members defining a contact chamber located between the end wall and an intermediate location of said side wall, a coil chamber in the open access end of said housing extending between the ends of said locating members and said open access end, an outer magnetic can formed of a magnetic material and having a base abutting the ends of said locating members and having an outer open end, a plurality of longitudinally extended spacing members located between the wall of said coil section and the side wall of said can and defining a friction engaging force on said can for releasably holding the can in place, a cylindrical coil assembly located within said can, said coil assembly including an annular bobbin with a central axial tube and end flanges with a cylindrical coil wound on said tube between said flanges, said inner end flange of the bobbin adjacent said can base, said inner end flange of said bobbin having a plurality of spacing members interposed between the base of said can and said flange to define a space therebetween and said bobbin including a finger structure engaged with the housing to prevent rotation of said bobbin and thereby said coil assembly, a magnetic plug secured to the base of said can and extending into said bobbin axial tube, an armature axially sliding in said tube outwardly of said plug and of a length defining a gap between said plug and said armature with the armature located adjacent said open access end, a closing magnetic plate secured to the outer open end of said can, a bottom cover secured to the open access end of said housing and including an outwardly located central portion aligned with the bobbin and said armature and spaced outwardly thereof, a flat resilient flexible gasket interposed between said outer end flange of said bobbin and said cover and spanning the opening of the housing and engaging said adjacent outer end flange of said bobbin, said gasket being constructed and arranged as a resilient support for said can and holding said can and coil unit in abutting relation to said locating members, a contact assembly including a contact plate located within said contact chamber and spanning the housing between said inner edges of said locating members, said locating members providing a guided axial movement within said housing between an open contact position and a closed contact position engaging said power terminals, said contact assembly including a resiliently mounted transfer unit including a rod extended through said plug and into releasable coupling to said armature for selectively positioning of said contact member between said open and closed position in accordance with the energization of said coil unit.

28. The apparatus of claim 27 wherein said power terminal each includes a single integrated unit including an outer exposed threaded stud and an enlarged head embedded within said top wall, said enlarged head having an intermediate locking portion and an inner portion projecting outwardly of said surface of said end wall and forming a power contact within said contact section and having an outer portion projecting outwardly from said locking portion outwardly of the outer surface of said end wall and having a threaded stud projecting outwardly from said outer flat wall, said locking portion having a knurled portion providing for axial support of said terminal within said end wall and circumferential support of said terminal within said end wall whereby said stud is firmly supported against deflection as a result of locking torque applied to said stud and against axial forces applied to said stud.

29. The apparatus of claim 28 wherein said contact member is a metal plate, an insulating bushing is mounted within a central opening in said mounting plate and includes a flange abutting the metal plate to the inner side of said metal within said contact section, a brass rod extends through said bushing and having a head abutting said bushing, said rod extending downwardly through said plug and extending into said armature, said armature having a recess corresponding generally to the configuration of said rod for receiving the end of said rod with a loose releasable coupling whereby inward movement of said armature pushes said rod upwardly to transfer said contact plate to the closing position.

30. The apparatus of claim 28 wherein said gasket is formed of flat resilient flexible material.

31. The apparatus of claim 30 wherein said locking portion includes a knurled portion extending circumferentially about said locking portion.

32. The apparatus of claim 31 wherein said knurled portion encompasses the total circumference or extends for 360 degrees of said locking portion.

33. The apparatus of claim 27 wherein said bottom flange includes an outward extension therefrom, a first and second coil contact located in spaced relation to each other within said flange flange, each of said coil contacts including a single integrated solid conductor consisting of a stud for receiving a lead and an enlarged head embedded within said flange, said head including a knurled locking portion for locking of the contact within said flange.

34. The apparatus of claim 28, wherein said knurled portion includes a pair of spaced knurled portions connected by a groove, said first and second knurled portion each consisting of circumferentially spaced and longitudinally extended grooves connected by a sharp edge whereby said knurled portions resist torque on said terminal, said groove between said first and second knurled portions resist axial force on said studs.

* * * * *

UNITED STATES PATENT AND TRADEMARK OFFICE

CERTIFICATE OF CORRECTION

PATENT NO. : 5,521,566
DATED : May 28, 1996
INVENTOR(S) : Krubsack et al

It is certified that error appears in the above-indentified patent and that said Letters Patent is hereby corrected as shown below:

Column 9, line 10, claim 10, after "open" insert ---access---; Column 11, line 37, claim 22, after "second" delete "power contact"; Column 11, line 45, claim 23, after "second" insert ---power contact---;Column 14, line 32, claim 33, after "said" and before "flange" delete "flange" and substitute therefor ---bottom---.

Signed and Sealed this

Twenty-sixth Day of November 1996

*Attest:*

*Attesting Officer*

BRUCE LEHMAN

*Commissioner of Patents and Trademarks*